US011781721B2

(12) United States Patent
Li et al.

(10) Patent No.: US 11,781,721 B2
(45) Date of Patent: Oct. 10, 2023

(54) VEHICLE LAMP OPTICAL ELEMENT ASSEMBLY, VEHICLE LAMP AND AUTOMOBILE

(71) Applicant: HASCO VISION TECHNOLOGY CO., LTD., Shanghai (CN)

(72) Inventors: Hui Li, Shanghai (CN); Zhiping Qiu, Shanghai (CN); He Zhu, Shanghai (CN); Weigang Gong, Shanghai (CN); Dapan Zhang, Shanghai (CN); Xiaofen Sun, Shanghai (CN); Cong Li, Shanghai (CN); Rui Nie, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 37 days.

(21) Appl. No.: 17/620,757

(22) PCT Filed: Sep. 5, 2019

(86) PCT No.: PCT/CN2019/104574
§ 371 (c)(1),
(2) Date: Dec. 20, 2021

(87) PCT Pub. No.: WO2020/258517
PCT Pub. Date: Dec. 30, 2020

(65) Prior Publication Data

US 2022/0412528 A1 Dec. 29, 2022

(30) Foreign Application Priority Data

Jun. 25, 2019 (CN) ..... 201910556042.6
Jun. 25, 2019 (CN) ..... 201920964167.8

(51) Int. Cl.
*F21S 41/29* (2018.01)
*F21S 41/63* (2018.01)
*F21S 41/27* (2018.01)

(52) U.S. Cl.
CPC ..... *F21S 41/29* (2018.01); *F21S 41/27* (2018.01)

(58) Field of Classification Search
CPC ..... F21V 5/008; F21V 14/06; F21V 14/065; F21S 43/27; F21S 43/40; F21S 41/29; F21S 41/295; F21S 41/635
See application file for complete search history.

(56) References Cited

U.S. PATENT DOCUMENTS

2014/0321145 A1* 10/2014 Anzai ..... F21S 41/295 362/516

FOREIGN PATENT DOCUMENTS

CN 204372757 A 6/2015
CN 208107675 X 11/2018
(Continued)

*Primary Examiner* — Sean P Gramling
(74) *Attorney, Agent, or Firm* — Volpe Koenig

(57) ABSTRACT

The present invention relates to the technical field of vehicle illumination and, in particular, relates to a vehicle lamp optical element assembly, a vehicle lamp comprising the vehicle lamp optical element assembly, and an automobile comprising the vehicle lamp. The vehicle lamp optical element assembly comprises a primary optical element assembly and a secondary optical element assembly, wherein the primary optical element assembly comprises a primary optical element and a first support for supporting the primary optical element, and the secondary optical element assembly comprises a secondary optical element and a second support for supporting the secondary optical element, wherein the first support and the second support are connected in a matching manner so as to enable the primary optical element and the secondary optical element to be
(Continued)

relatively fixed. The primary optical element and the secondary optical element are assembled into an integral structure, such that relative positions of the primary optical element and the secondary optical element are directly determined, and direct positioning between the primary optical element and the secondary optical element is realized. The positioning precision and the mounting reliability of the primary optical element and the secondary optical element can be ensured, such that the accuracy and functional stability of a light shape of the vehicle lamp are ensured.

8 Claims, 7 Drawing Sheets

(56) References Cited

FOREIGN PATENT DOCUMENTS

| | | |
|---|---|---|
| CN | 109404856 A | 3/2019 |
| CN | 110173669 | 8/2019 |

* cited by examiner

VEHICLE LAMP OPTICAL ELEMENT ASSEMBLY, VEHICLE LAMP AND AUTOMOBILE

CROSS REFERENCE TO RELATED APPLICATION

The present application claims the benefit of priority to Chinese Patent Application No. CN 201910556042.6, and Chinese Patent Application No. CN 201920964167.8, both entitled "VEHICLE LAMP OPTICAL ELEMENT ASSEMBLY, VEHICLE LAMP AND AUTOMOBILE", filed with CNIPA on Jun. 25, 2019, the disclosure of both are incorporated herein by reference in its entirety.

FIELD OF TECHNOLOGY

The present invention relates to the technical field of vehicle illumination, in particular to a vehicle lamp optical element assembly, a vehicle lamp including the vehicle lamp optical element assembly, and an automobile including the vehicle lamp.

BACKGROUND

A vehicle lamp optical element system is an important part of a vehicle lamp. Usually, the vehicle lamp optical element system includes a primary optical element assembly and a secondary optical element assembly, the primary optical element assembly includes primary optical elements such as a condenser, and the secondary optical element assembly includes secondary optical elements such as lens. The positioning precision and mounting reliability between the primary optical element assembly and the secondary optical element assembly have a great impact on the precision of a light shape of the vehicle lamp, and reliable positioning and mounting can ensure the accuracy and functional stability of the light shape of the vehicle lamp.

Currently, the way to position and mount the primary optical element assembly and the secondary optical element assembly is fixing the two on a radiator respectively which means indirect determination of their relative position. Such indirect positioning and mounting manner not only lead to complex structure of the optical element system and tedious mounting steps, but also have a large mounting error, thereby being incapable of achieving precise positioning between the primary optical element assembly and the secondary optical element assembly, and affecting the accuracy and functional stability of the light shape of the vehicle lamp.

SUMMARY

The present invention provides a vehicle lamp optical element assembly with high positioning precision and favorable mounting reliability.

The present invention adopts the following technical solution: a vehicle lamp optical element assembly includes a primary optical element assembly and a secondary optical element assembly, where the primary optical element assembly includes a primary optical element and a first support for supporting the primary optical element, and the secondary optical element assembly includes a secondary optical element and a second support for supporting the secondary optical element, where the first support and the second support are connected in a matching manner, so as to enable the primary optical element and the secondary optical element to be relatively fixed.

Preferably, the first support includes a supporting frame and a limiting element, where the limiting element is fixedly arranged on the primary optical element, and the supporting frame is provided with a limiting slot, where the limiting element is connected with the limiting slot in a matching manner and is relatively fixed with the supporting frame.

Preferably, the limiting element is provided with a first positioning hole, and the limiting slot is internally provided with a first positioning pin which is matched with the first positioning hole in an inserting manner.

Preferably, the second support is provided with a slot, the first support is matched with the slot in an inserting manner, and the first support is provided with positioning surfaces in contact with surfaces on the inner side of the slot.

Preferably, the secondary optical element is arranged at a front end of the second support, the slot penetrates through a rear end face of the second support and extends from back to front, and the positioning surfaces of the first support include a front positioning surface arranged at a front end face of the first support, an upper positioning surface arranged at an upper surface of the first support and a lower positioning surface arranged at a lower surface of the first support, where the front positioning surface is in contact with a front surface on the inner side of the slot, the upper positioning surface is in contact with an upper surface on the inner side of the slot, and the lower positioning surface is in contact with a lower surface on the inner side of the slot.

Preferably, the slot penetrates through the second support in the left-right direction, and the first support is provided with clamping parts on the left and right sides, respectively, and two opposite inner side surfaces of the two clamping parts are in contact with the left and right side surfaces of the second support, respectively.

Preferably, a rear end of the first support is provided with a rear positioning surface configured to connect with a surface of a circuit board, and the rear end face of the second support is provided with a protruding part in communication with the surface of the circuit board.

Preferably, the rear end of the first support is provided with a second positioning pin configured to be matched with the second positioning hole on the circuit board in an inserting manner.

The present invention further provides a vehicle lamp, including the vehicle lamp optical element assembly as described above.

The present invention further provides an automobile, including the vehicle lamp as described above.

The present invention has following dramatic improvements:

the vehicle lamp optical element assembly, the vehicle lamp including the vehicle lamp optical element assembly and the automobile including the vehicle lamp of the present invention, through the matched connection between the first support and the second support, the primary optical element and the secondary optical element are assembled into an integral structure resulting in direct determination of the relative position of the two, thereby realizing direct positioning between the primary optical element and the secondary optical element. When the vehicle lamp optical element assembly of the present invention is mounted on the circuit board and the radiator, no positioning error will be generated during the assembly with the circuit board and the radiator due to the fixed assembly positioning relationship exists between the primary optical element and the secondary optical element. Therefore positioning precision and mounting reliability of the primary optical element and the secondary optical element are guaranteed, and further accuracy and functional stability of the light shape of the vehicle lamp are ensured.

REFERENCE NUMERALS

Figure 1:
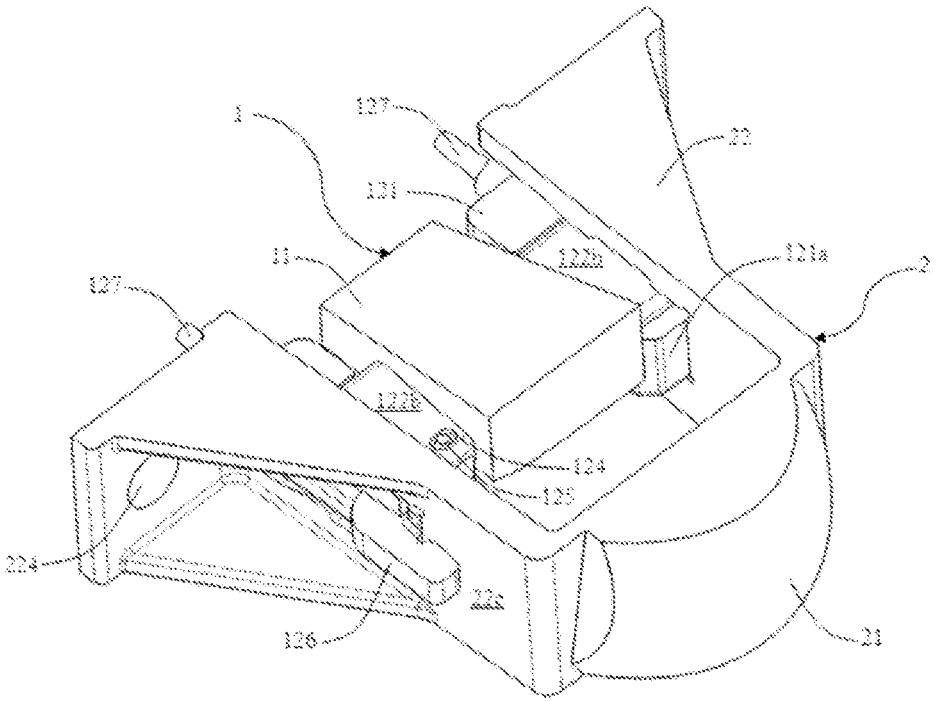
FIG. 1 shows a three-dimensional structural schematic diagram of a vehicle lamp optical element assembly in the embodiment of the present invention.

1, primary optical element assembly
11, primary optical element
12, first support
121, supporting frame
121*a*, front end face of the supporting frame
121*b*, lower surface of the supporting
121*c*, rear end face of the supporting frame
122, limiting element
122*a*, lower surface of the limiting element
122*b*, upper surface of the limiting element
123, limiting slot
123*a*, bottom surface of the limiting slot
124, first positioning hole
125, first positioning pin
126, clamping part
126*a*, inner side surface of the clamping part
127, second positioning pin
2, secondary optical element assembly
21, secondary optical element
22, second support
22*a*, rear end face of the second support
22*b*, left side surface of the second support
22*c*, right side surface of the second support
221, slot
221*a*, front surface on the inner side of the slot
221*b*, upper surface on the inner side of the slot
221*c*, lower surface on the inner side of the slot
222, passage slot
223, protruding part
224, first threaded hole
3, circuit board
3*a*, surface of the circuit board
31, second positioning hole
32, positioning slot
33, second threaded hole
4, radiator
41, positioning bulge
5, screwed connecting element

DETAILED DESCRIPTION

Specific embodiments of the present invention will be described in further details below in combination with the accompanying drawings. These embodiments are merely intended to illustrate the present invention, rather than to limit the present invention.

In the description of the present invention, it should be noted that, the orientation or positional relationship indicated by terms, such as "center", "vertical", "horizontal", "up", "down", "front", "rear", "left", "right", "longitudinal", "transverse", "top", "bottom", "inner" and "outer" is the orientation or positional relationship based on the accompanying drawings. Such terms are merely for the convenience of description of the present invention and simplified description, rather than indicating or implying that the device or element referred to must be located in a certain orientation or must be constructed or operated in a certain orientation. Therefore, the terms cannot be understood as a limitation to the present invention. In addition, the terms "first" and "second" are merely for descriptive purpose, rather than indicating or implying relative importance.

In the description of the present invention, it should be noted that, unless otherwise specified and defined definitely, terms such as "install", "connect" and "in connection" should be understood in their broad sense, e.g., the connection can be a fixed connection, or a detachable connection or an integral connection; can be a mechanical connection or an electrical connection; can be a direct connection or an indirect connection through an intermediate, or an internal communication between two elements. For those skilled in the art, the specific meanings of the above terms in the present invention can be understood according to specific conditions.

In addition, in the description of the present invention, unless otherwise specified, "a plurality of" means two or more than two.

Please refer to FIGS. 1 to 13 which show an embodiment of a vehicle lamp optical element assembly in the present invention.

Figure 2:
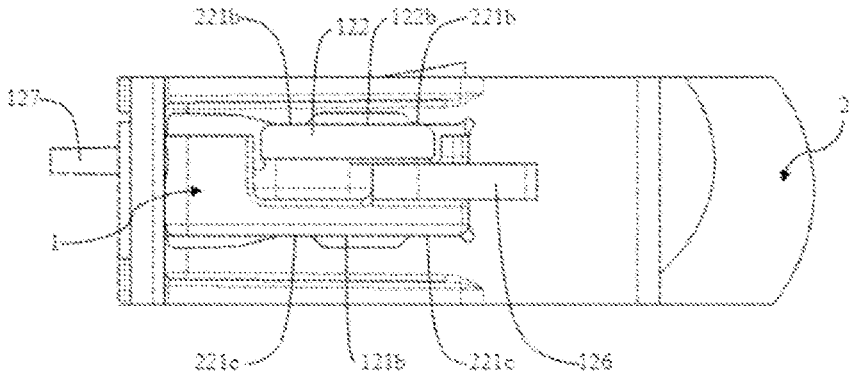
FIG. 2 shows a schematic diagram of a side view of the vehicle lamp optical element assembly in the embodiment of the present invention.
Figure 3:
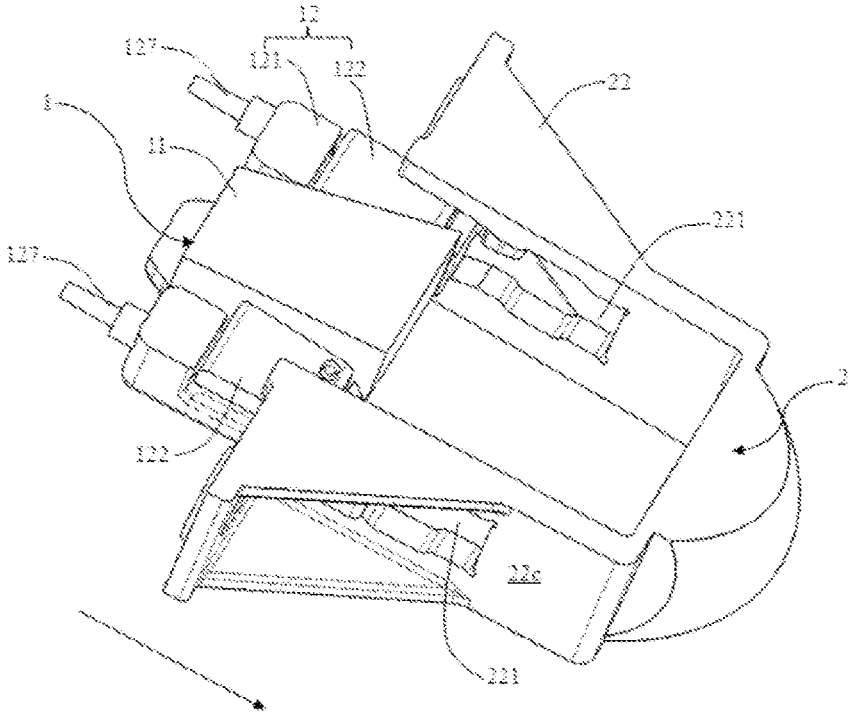
FIG. 3 shows a schematic diagram of an assembly process of the vehicle lamp optical element assembly in the embodiment of the present invention.
Figure 4:
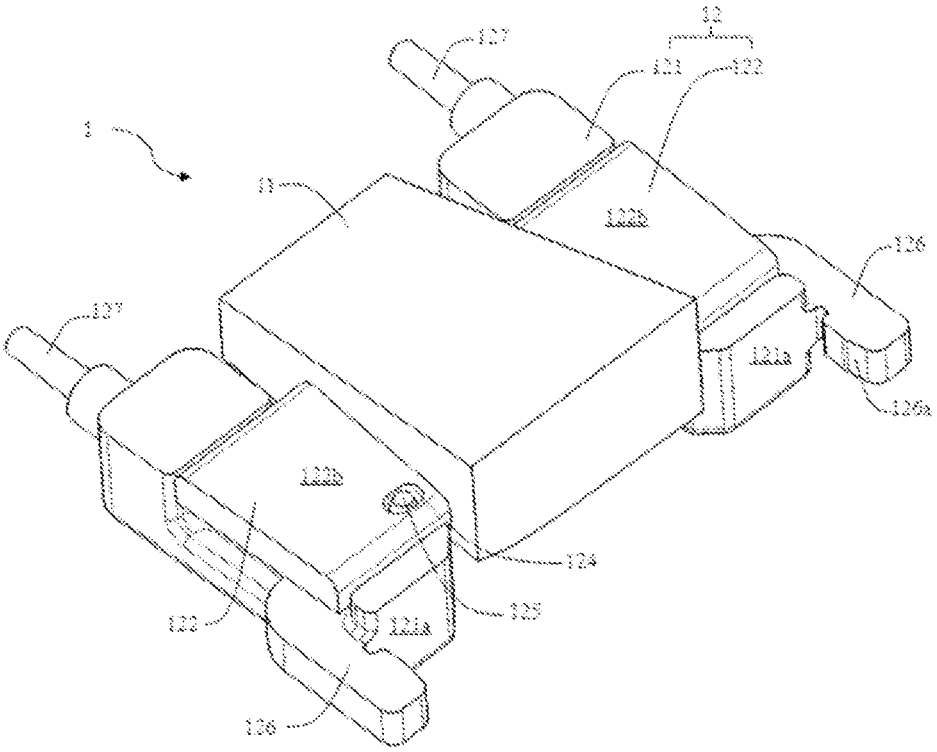
FIG. 4 shows a structural schematic diagram of a primary optical element assembly in the vehicle lamp optical element assembly in the embodiment of the present invention when being viewed from an angle.

Please refer to FIGS. 1 to 3, the vehicle lamp optical element assembly of the present embodiment includes a primary optical element assembly 1 and a secondary optical element assembly 2. The primary optical element assembly 1 includes a primary optical element 11 and a first support 12, and the first support 12 supports the primary optical element 11. The secondary optical element assembly 2 includes a secondary optical element 21 and a second support 22, and the second support 22 supports the secondary optical element 21. The first support 12 and the second support 22 are connected in a matching manner, so as to enable the primary optical element 11 and the secondary optical element 21 to be relatively fixed. Therefore, through the matched connection between the first support 12 and the second support 22, the primary optical element 11 and the secondary optical element 21 are assembled into an integral structure to directly determine the relative position of the two, thereby realizing direct positioning between the primary optical element 11 and the secondary optical element 21. Please refer to FIGS. 11 and 12, when the vehicle lamp optical element assembly of the present embodiment is mounted on the circuit board 3 and the radiator 4, no positioning error will be generated during the assembly with the circuit board 3 and the radiator 4 due to the fixed assembly positioning relationship existing between the primary optical element 11 and the secondary optical element 21. Thus, the positioning precision and mounting reliability of the primary optical element 11 and the secondary optical element 21 are guaranteed, and further accuracy and functional stability of the light shape of the vehicle lamp are ensured.

When the vehicle lamp optical element assembly of the present embodiment is mounted on the circuit board 3, the primary optical element 11 is arranged between the circuit board 3 and the secondary optical element 21. The light emitted by the light source on the circuit board 3 passes through the primary optical element 11 and the secondary optical element 21 in sequence and is then emitted, to form a light shape of the vehicle lamp. In the present invention, to facilitate description, the distribution direction of the circuit board 3, the primary optical element 11 and the secondary optical element 21 is defined to be from back to front, that is, the circuit board 3 is arranged at the rear of the primary optical element 11, the secondary optical element 21 is arranged in front of the primary optical element 11. The direction vertical to the front-back direction in the horizontal plane is the left-right direction, and the direction perpendicular to the front-back direction in the vertical plane is the up-down direction.

Please refer to FIGS. 4 to 8, in the present embodiment, preferably, the first support 12 in the primary optical element assembly 1 includes a supporting frame 121 and limiting elements 122. The limiting elements 122 are fixedly arranged on the primary optical element 11. The supporting frame 121 is provided with limiting slots 123, the limiting elements 122 are connected with the limiting slots 123 in a matching manner, and the limiting elements 122 are fixed relative to the supporting frame 121. Therefore, through the matched connection between the limiting elements 122 and the supporting frame 121, the primary optical element 11 is relatively fixed with the supporting frame 121, then the primary optical element 11 is positioned and supported on the first support 12, that is, the limiting elements 122 and the supporting frame 121 are assembled together to constitute a first support 12 supporting the primary optical element 11. In a preferred embodiment, the upper surface of the supporting frame 121 is partially sunken to form the limiting slots 123, such that the bottom surfaces 123*a* of the limiting slots 123 face upwards and are horizontal planes. The lower surfaces 122*a* of the limiting elements 122 are horizontal planes, and the limiting elements 122 are placed in the limiting slots 123, so that the lower surfaces 122*a* of the limiting elements 122 are in contact match with the bottom surfaces 123*a* of the limiting slots 123.

To increase the accuracy of assembly positioning between the limiting elements 122 and the supporting frame 121, preferably, the limiting elements 122 are provided with first positioning holes 124, the limiting slots 123 are internally provided with first positioning pins 125, and the first positioning pins 125 are matched with the first positioning holes 124 in an inserting manner. When the limiting elements 122 are mounted to the supporting frame 121, the relative position of the limiting elements 122 and the supporting frame 121 can be restricted, through the inserting match between the first positioning pins 125 and the first positioning holes 124. Therefore, the limiting elements 122 can be accurately positioned, and accurate positioning between the primary optical element 11 and the first support 12 can be realized.

Further, to ensure positioning and mounting reliability between the primary optical element 11 and the first support 12, preferably, two limiting elements 122 may be arranged at the left and right sides of the primary optical element 11 respectively. The supporting frame 121 is provided with two limiting slots 123 in matched connection with the two limiting elements 122, and the two limiting slots 123 are respectively arranged on the left and right sides of the supporting frame 121. The two limiting slots 123 are both internally provided with a first positioning pin 125, and the first positioning pins 125 are respectively matched with the first positioning holes 124 on the two limiting elements 122 in an inserting manner. Therefore, the primary optical element 11 is jointly supported and positioned on the supporting frame 121 through the left and right limiting elements 122. And the two limiting elements 122 realize positioning with the supporting frame 121 through the inserting match between the first positioning holes 124 and the second positioning pins 125 respectively, thereby effectively increasing the positioning precision and mounting reliability between the primary optical element 11 and the first support 12.

Further, to facilitate assembling and prevent over-positioning, preferably, the first positioning hole 124 on one of the two limiting elements 122 is a circular hole, and the first positioning hole 124 on the other limiting element 122 is a waist-shaped hole. The cross-sectional shape of the first positioning pins 125 in the two limiting slots 123 are both circular. One of the first positioning pins 125 is in matched connection with the first positioning hole 124 which is a circular hole, and the other first positioning pin 125 is in matched connection with the first positioning hole 124 which is a waist-shaped hole. Through the matched connection between the first positioning pin 125 and the first positioning hole 124 which is a waist-shaped hole, the machining error of the limiting elements 122 and the supporting frame 121 can be compensated, such that the assembling of the two is easier.

In the present embodiment, preferably, the secondary optical element 21 and the second support 22 in the secondary optical element assembly 2 may be molded into an integral piece.

Please refer to FIGS. 1, 2, 9 and 10, in the present embodiment, preferably, the second support 22 in the secondary optical element assembly 2 is provided with slots 221, the first support 12 matches with the slots 221 in an inserting manner, and the first support 12 is provided with positioning surfaces in contact with the inner surfaces of the slots 221. Through the contact match of the positioning surfaces of the first support 12 and the inner side surfaces of the slots 221, the relative positions of the first support 12 and the second support 22 can be restricted, so that the first support 12 and the second support 22 are fixed relative to each other, and the assembling and positioning between the first support 12 and the second support 22 are realized, thereby possessing the advantages of easy mounting and reliable positioning.

In the present embodiment, in order to match with the case that the two limiting elements 122 are respectively arranged on the left and right sides of the primary optical element 21 in the primary optical element assembly 1, two slots 221 are respectively arranged on the left and right sides of the second support 22. An assembling space is formed between the two slots 221 for the insertion of the primary optical element assembly 1. After the two limiting elements 122 are assembled into the corresponding limiting slots 123 on the supporting frame 121, the two limiting elements and the supporting frame 121 constitute an entirety and are inserted into the corresponding slots 221, thereby realizing the assembling of the first support 12 and the second support 22. The primary optical element 11 is arranged in the assembling space between the two slots 221.

To facilitate assembly of the first support 12 and the second support 22, and enable the secondary optical element 21 to be arranged in front of the primary optical element 11, preferably, the secondary optical element 21 is arranged at the front end of the second support 22, and the slots 221 penetrate through the rear end face 22*a* of the second support 22 and extend from back to front. Therefore, the first support 12 can insert into the slots 221 from the rear end of the slots 221 and forward into the slots 221 along the direction shown by the arrow in FIG. 3, until the positioning surfaces of the first support 12 are in contact with and matched with the inner surfaces of the slots 221. The primary optical element 11 supported on the upper surface of the first support 12 is arranged at the rear of the secondary optical element 21.

To ensure that the contact match between the positioning surfaces of the first support 12 and the inner side surfaces of the slots 221 can effectively define the relative position of the first support 12 and the second support 22, preferably, the inner side surfaces of the slots 221 include front surfaces 221*a*, upper surfaces 221*b* and lower surfaces 221*c*, and the positioning surfaces of the first support 12 include front positioning surfaces located on the front end face of the first support 12, upper positioning surfaces located on the upper surface of the first support 12 and a lower positioning surface on the lower surface of the first support 12. The front positioning surfaces are in contact with the front surfaces 221*a* on the inner side of the slots 221, to limit the forward movement of the first support 12 relative to the second support 22; the upper positioning surfaces are in contact with the upper surfaces 221*b* on the inner side of the slots 221, to limit the upward movement of the first support 12 relative to the second support 22; and the lower positioning surface is in contact with the lower surfaces 221*c* on the inner side of the slots 221, to limit the downward movement of the first support 12 relative to the second support 22. In the present embodiment, the front end faces 121*a* of the supporting frame 121 located directly in front of the limiting slots 123 constitute the front positioning surfaces of the first support 12. After the limiting elements 122 are assembled into the limiting slots 123 on the supporting frame 121, the upper surfaces 122*b* of the limiting elements 122 are higher than that of the supporting frame 121, so that the upper surfaces 122*b* of the limiting elements 122 constitute the upper positioning surfaces of the first support 12. The lower surface 121*b* of the supporting frame 121 constitutes the lower positioning surface of the first support 12. Please refer to FIG. 2, in a preferred embodiment, the upper surfaces 221*b* of the inner side of the slots 221 are partially sunken with no contact match with the upper surfaces 122*b* of the limiting elements 122, and the lower surfaces 221*c* of the inner side of the slots 221 are partially sunken with no contact match with the lower surface 121*b* of the supporting frame 121, thereby reducing the contact area between the upper surfaces 221*b* of the inner side of the slots 221 and the upper surfaces 122*b* of the limiting elements 122, and reducing the contact area between the lower surfaces 221*c* of the inner side of the slots 221 and the lower surface 121*b* of the supporting frame 121, and forming small-area contact positioning. The machining precision of the small-area contact surface can be more easily guaranteed, such that the positioning surfaces of the first support 12 can better interfere with the surfaces inside the slots 221, thereby making the positioning more precise.

Further, in the present embodiment, preferably, the slots 221 penetrate through the second support 22 in the left-right direction, and the left and right sides of the first support 12 are respectively provided with a clamping part 126. The opposite inner side surfaces 126*a* of the two clamping parts 126 are respectively in contact with the left side surface 22*b* and the right side surface 22*c* of the second support 22, to limit the left-right movement of the first support 12 relative to the second support 22. In a preferred embodiment, the two clamping parts 126 are respectively arranged on the left and right side surfaces of the supporting frame 121 and both extend forwards to the front of the front end face 121*a* of the supporting frame 121. After assembly, the front end face 121*a* of the supporting frame 121 is in contact with the front surfaces 221*a* on the inner side of the slots 221, the two clamping parts 126 are arranged on the outer side of the second support 22, and the inner side surfaces 126*a* of the two clamping parts 126 are respectively in contact match with the area of the left side surface 22*b* and the right side surface 22*c* of the second support 22 that are in front of the slots 221. In order to enable the clamping parts 126 of the first support 12 can reach the outer side in front of the slots 221 through the rear end of the slots 221, the rear end of the second support 22 is provided with passage slots 222 that penetrate through the second support 22 back and forth. The openings of the passage slots 222 face towards the slots 221 and are communicated with the rear end of the slots 221 on the outer side of the slots 221. When the supporting frame 121 and the limiting elements 122 are inserted into the slots 221, the clamping parts 126 on the side surfaces of the supporting frame 121 pass through the passage slots 222 and reach the outer side in front of the slots 221.

Figure 5:
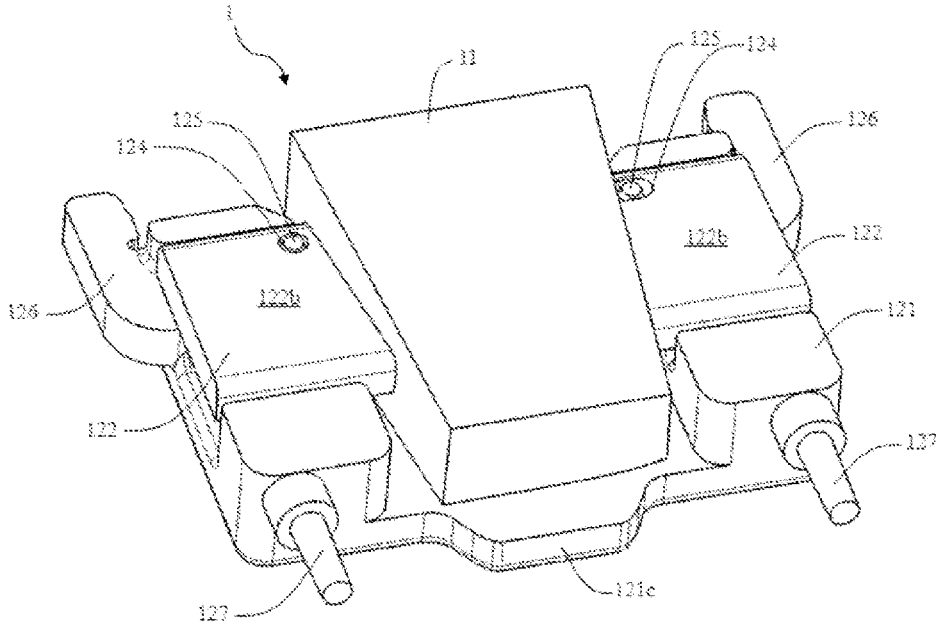
FIG. 5 shows a structural schematic diagram of a primary optical element assembly in the vehicle lamp optical element assembly in the embodiment of the present invention when being viewed from another angle.
Figure 6:
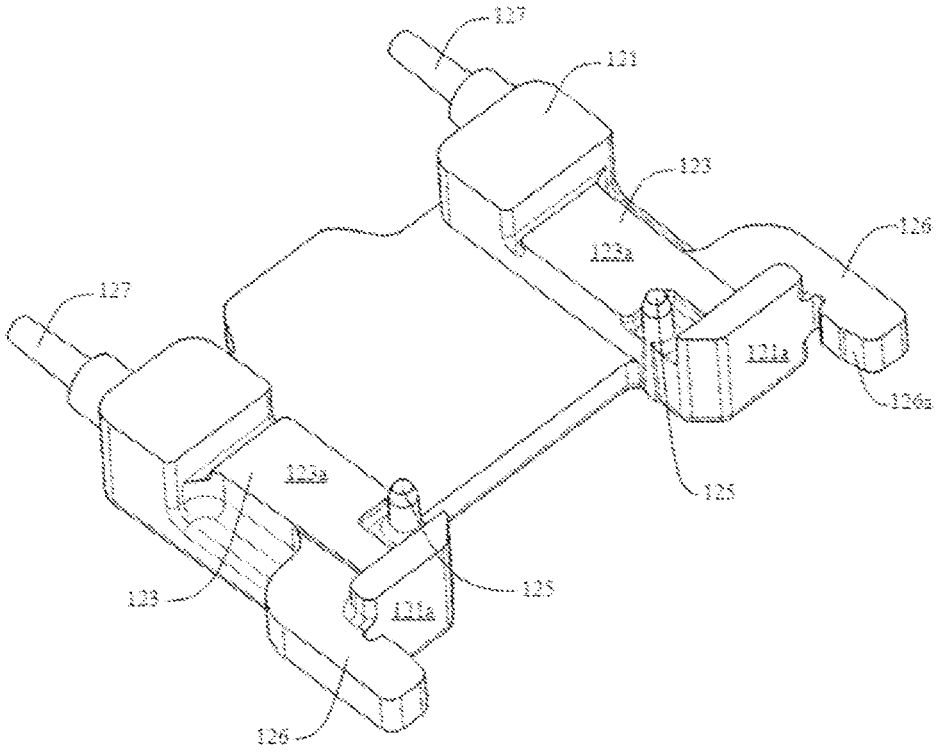
FIG. 6 shows a structural schematic diagram of a supporting frame in the vehicle lamp optical element assembly in the embodiment of the present invention.
Figure 7:
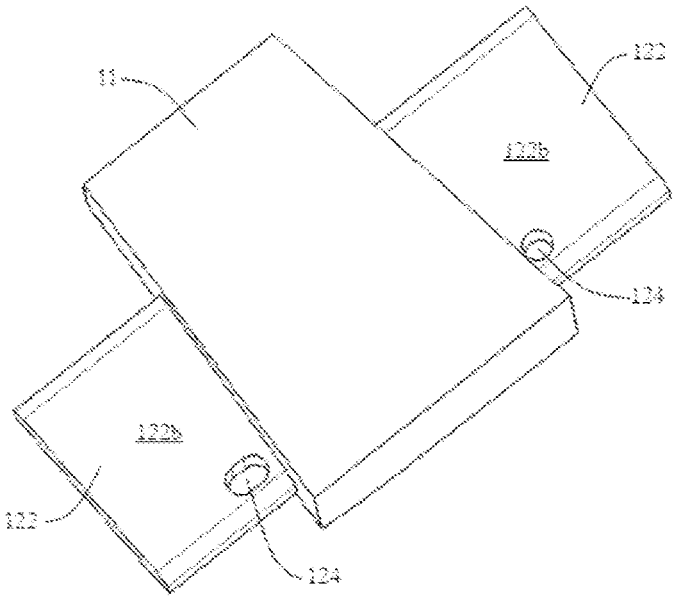
FIG. 7 shows a structural schematic diagram of a primary optical element assembly and a limiting element in the vehicle lamp optical element assembly in the embodiment of the present invention when being viewed from an angle.
Figure 8:
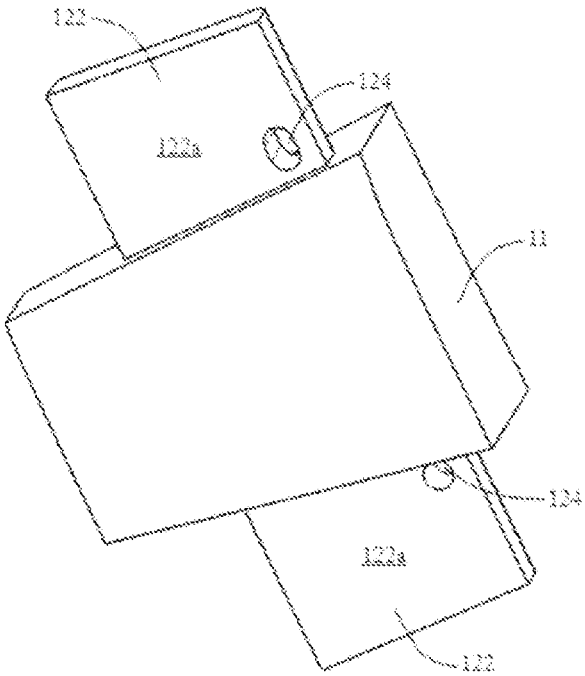
FIG. 8 shows a structural schematic diagram of a primary optical element assembly and a limiting element in the vehicle lamp optical element assembly in the embodiment of the present invention when being viewed from another angle.
Figure 9:
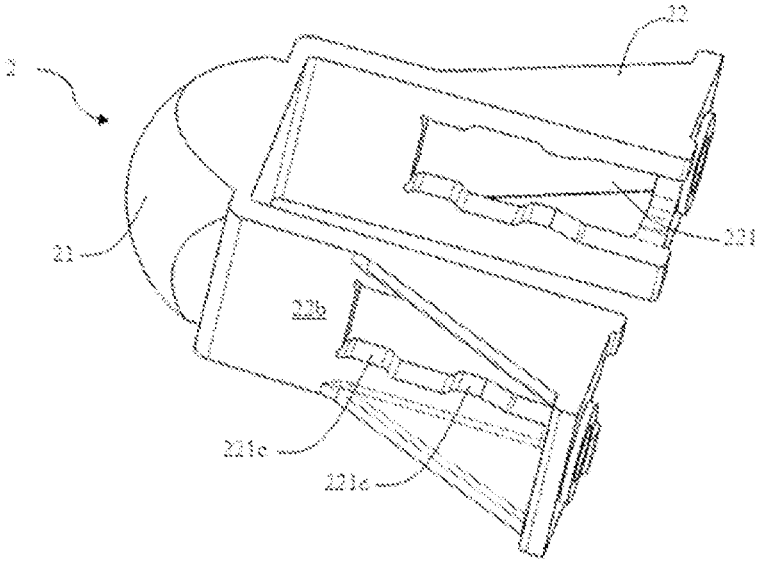
FIG. 9 shows a structural schematic diagram of a secondary optical element assembly in the vehicle lamp optical element assembly in the embodiment of the present invention when being viewed from an angle.
Figure 10:
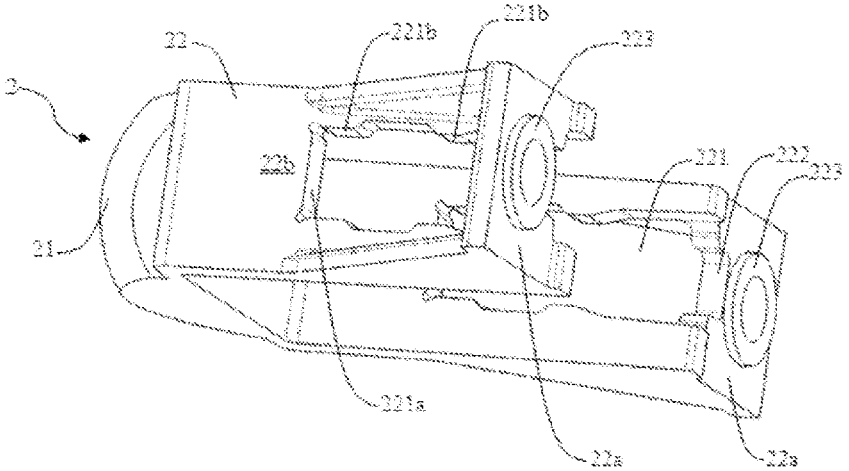
FIG. 10 shows a structural schematic diagram of a secondary optical element assembly in the vehicle lamp optical element assembly in the embodiment of the present invention when being viewed from another angle.
Figure 11:
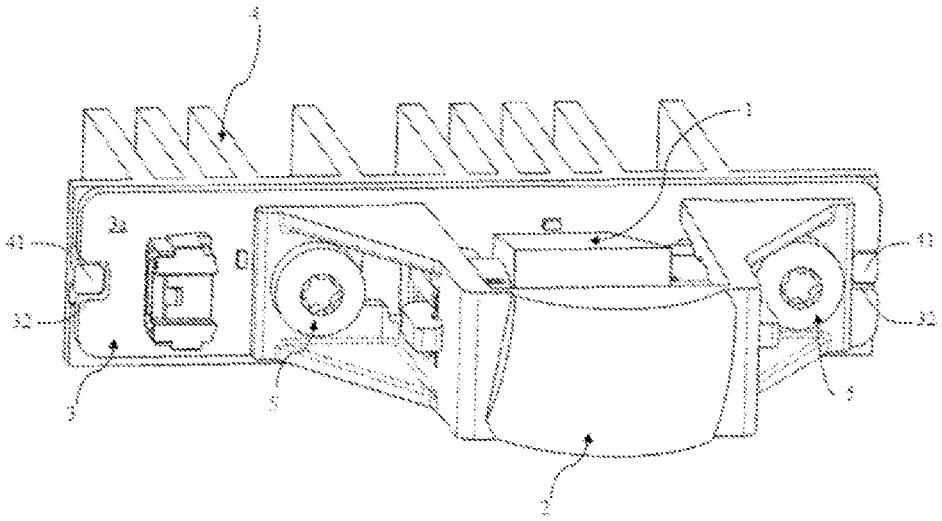
FIG. 11 shows a three-dimensional structural schematic diagram of the vehicle lamp optical element assembly being mounted on a circuit board and a radiator in the embodiment of the present invention.
Figure 12:
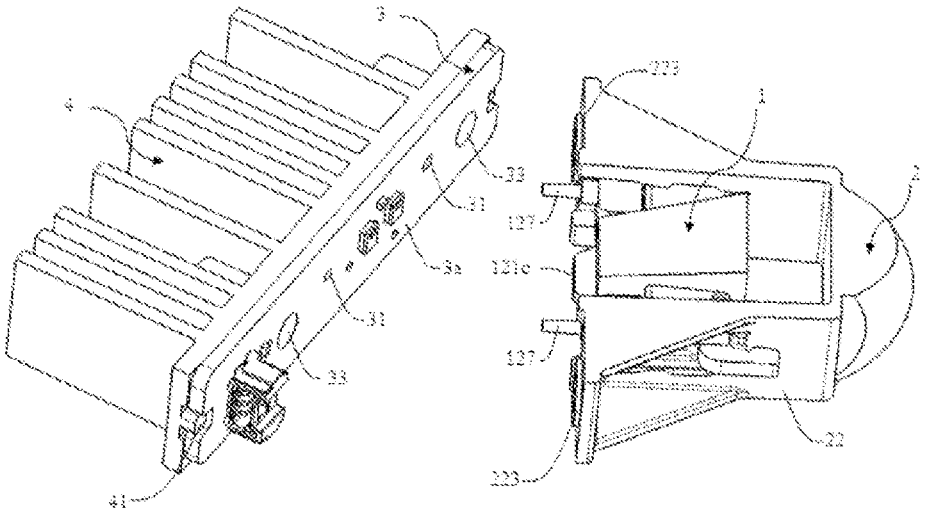
FIG. 12 shows a decomposition diagram of FIG. 11.

Please refer to FIGS. 5, 10 and 12, in the present embodiment, preferably, the rear end of the first support 12 is provided with a rear positioning surface configured to connect with the surface 3*a* of the circuit board 3. The rear end face 22*a* of the second support 22 is provided with protruding parts 223 in communication with the surface 3*a* of the circuit board 3. When the vehicle lamp optical element assembly of the present embodiment is mounted on the circuit board 3, the backward movement of the first support 12 relative to the second support 22 can be limited and the vehicle lamp optical element assembly is positioned on the surface 3*a* of the circuit board 3 through the contact match between the rear positioning surface of the first support 12 and the surface 3*a* of the circuit board 3 and the connection match between the protruding parts 223 at the rear end of the second support 22 and the surface 3*a* of the circuit board 3. In the present embodiment, the rear end face 121*c* of the supporting frame 121 constitutes the rear positioning surface of the first support 12. Preferably, two protruding parts 223 may be respectively arranged at the left and right sides of the rear end face 22*a* of the second support 22. Protruding parts 223 in communication with the surface 3*a* of the circuit board 3 are arranged on the rear end face 22*a* of the second support 22, thereby avoiding contact between the entire rear end face 22*a* of the second support 22 and the surface 3*a* of the circuit board 3, reducing the contact area between the rear end of the second support 22 and the surface 3*a* of the circuit board 3, and forming small-area contact positioning. The processing precision of the small-area contact surface is more easily ensured, such that the protruding parts 223 and the surface 3*a* of the circuit board 3 can be better interfered, and the positioning is more precise.

Figure 13:
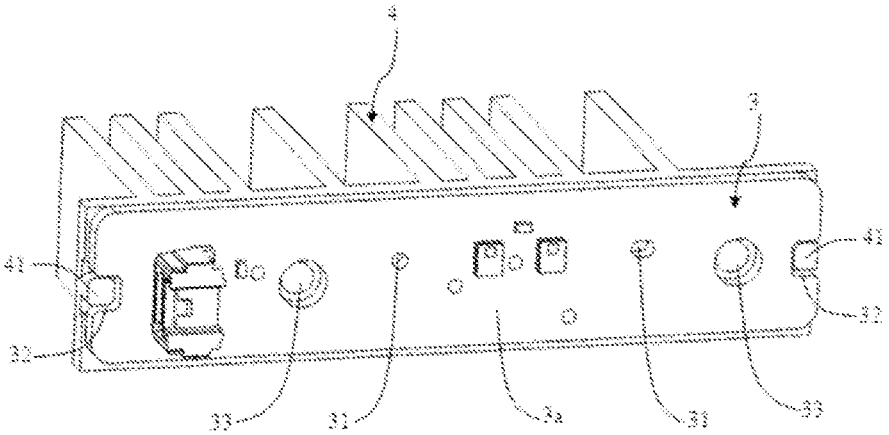
FIG. 13 shows a structural schematic diagram of the circuit board and the radiator shown in FIG. 11.

To increase the accuracy of assembling and positioning between the vehicle lamp optical element assembly and the circuit board 3, please refer to FIGS. 12 and 13, preferably, the rear end of the first support 12 is provided with second positioning pins 127 extend backward. The circuit board 3 is provided with second positioning holes 31, and the second positioning pins 127 match with the second positioning holes 31 in an inserting manner. When the vehicle lamp optical element assembly in the present embodiment is mounted on the circuit board 3, the relative position between the vehicle lamp optical element assembly and the circuit board 3 can be defined through the inserting match between the second positioning pins 127 and the second positioning holes 31, so as to accurately position the vehicle lamp optical element assembly, and realize accurate positioning between the vehicle lamp optical element assembly and the circuit board 3. To ensure the positioning and mounting reliability between the vehicle lamp optical element assembly and the circuit board 3, preferably, the rear end of the first support 12 is provided with two second positioning pins 127, and the two second positioning pins 127 are respectively arranged on the left and right sides of the rear end of the first support 12. Correspondingly, the circuit board 3 is provided with two second positioning holes 31 which respectively match with the two second positioning pins 127 in an inserting manner.

Further, to facilitate assembly and prevent over-positioning, preferably, one of the two second positioning holes 31 on the circuit board 3 is a circular hole, and the other is a waist-shaped hole. The cross-sectional shape of the two second positioning pins 127 at the rear end of the first support 12 are both circular. One of the two second positioning pins 127 is in matched connection with the second positioning hole 31 which is a circular hole, and the other second positioning pin 127 is in matched connection with the second positioning hole 31 which is a waist-shaped hole. Through the matched connection between the second positioning pin 127 and the second positioning hole 31 which is a waist-shaped hole, the machining error of the first support 12 and the circuit board 3 can be compensated, such that the assembly of the two is easier.

After the vehicle lamp optical element assembly of the present embodiment is assembled, the assembled vehicle lamp optical element assembly should be mounted onto the circuit board 3 and the radiator 4. Please refer to FIGS. 11, 12 and 13, before mounting the vehicle lamp optical element assembly of the present embodiment, the circuit board 3 can be pre-positioned on the radiator 4. Preferably, the radiator 4 is provided with at least one positioning bulge 41, the circuit board 3 is provided with positioning slots 32 for the insertion of the positioning bulges 41. The pre-positioning of the circuit board 3 and the radiator 4 is realized through the inserting match between the positioning bulges 41 and the positioning slots 32. Since the relative position of the primary optical element 11 and the secondary optical element 21 in the vehicle lamp optical element assembly in the present embodiment has been determined, the positioning of the circuit board 3 and the radiator 4 does not need an especially high precision, resulting in the mounting process of the vehicle lamp optical element assembly on the circuit board 3 and the radiator 4 is simple and convenient. After the pre-positioning of the circuit board 3 and the radiator 4 is finished, the vehicle lamp optical element assembly is positioned on the surface 3*a* of the circuit board 3. Specifically, the two second positioning pins 127 at the rear end of the first support 12 respectively match with the two second positioning holes 31 on the circuit board 3 in an inserting manner, the rear positioning surface of the first support 12 is in contact match with the surface 3*a* of the circuit board 3, and the protruding parts 223 at the rear end of the second support 22 are in connection with the surface 3*a* of the circuit board 3. Then the vehicle lamp optical element assembly is fixedly connected with the circuit board 3 and the radiator 4 to finish the mounting of the vehicle lamp optical element assembly.

To realize fixed connection between the vehicle lamp optical element assembly of the present embodiment and the circuit board 3 and the radiator 4, please refer to FIG. 1, first threaded holes 224 are formed at the rear end of the second support 22 of the vehicle lamp optical element assembly in the present embodiment. Please refer to FIGS. 11 and 12, second threaded holes 33 are formed on the circuit board 3. The first threaded holes 224 and the second threaded holes 33 are in communication with each other and allow the screwed connecting elements 5 to penetrate through. And third threaded holes (not shown in the figure) are formed on the radiator 4 which are in matched connection with the screwed connecting elements 5. Therefore, the first threaded holes 224, the second threaded holes 33 and the third threaded holes are connected in sequence through the screwed connecting elements 5, to realize tightened connection between the vehicle lamp optical element assembly of the present embodiment and the circuit board 3 and the radiator 4, and further finish mounting of the vehicle lamp optical element assembly of the present embodiment.

In summary, as to the vehicle lamp optical element assembly of the present embodiment, the primary optical element 11 and the secondary optical element 21 are assembled into an integral structure through matched connection of the first support 12 and the second support 22, thereby realizing direct determination of the relative position and direct positioning of the primary optical element 11 and the secondary optical element 21. Moreover, the forward movement of the first support 12 relative to the second support 22 is limited through contact between the front positioning surfaces of the first support 12 (front end faces 121*a* of the supporting frame 121) and the front surfaces 221*a* on the inner side of the slots 221 of the second support 22. The upward movement of the first support 12 relative to the second support 22 is limited through the contact between the upper positioning surfaces of the first support 12 (upper surfaces 122*b* of the limiting elements 122) and the upper surfaces 221*b* on the inner side of the slots 221. The downward movement of the first support 12 relative to the second support 22 is limited through the contact between the lower positioning surface of the first support 12 (lower surface 121*b* of the supporting frame 121) and the lower surfaces 221*c* of the inner side of the slots 221. The left and right movement of the first support 12 relative to the second support 22 is limited through the contact between the two opposite inner side surfaces 126*a* of the two clamping parts 126 of the first support 12 and the left side surface 22*b* and the right side surface 22*c* of the second support 22, respectively. And the backward movement of the first support 12 relative to the second support 22 is limited through the contact match between the rear positioning surface of the first support 22 (the rear end face 121*c* of the supporting frame 121) and the surface 3*a* of the circuit board 3 and through the connected match between the protruding parts 223 at the rear end of the second support 22 and the surface 3*a* of the circuit board 3. Consequently, relative fixation of the first support 12 and the second support 22 along the front-back, up-down and left-right directions are realized, and all-round positioning precision and mounting stability of the first support 12 and the second support 22 are ensured, that is, the positioning precision and mounting stability of the primary optical element 11 and the secondary optical element 21 are ensured. After the vehicle lamp optical element assembly is used for a long time, the relative position between the primary optical element 11 and the secondary optical element 21 can still be maintained unchanged, so as to ensure the accuracy and stability of the light shape of the vehicle lamp. In addition, after assembling the primary optical element assembly 1 and secondary optical element assembly 2 into an integral structure and determining the relative positions of the primary optical element 11 and the secondary optical element 21, the integral structure can be mounted on the circuit board 3 and the radiator 4 which can reduce the positioning precision requirements of the circuit board 3 and the radiator 4 and make the mounting process easier and more convenient.

Based on the above vehicle lamp optical element assembly, the embodiment of the present invention further provides a vehicle lamp, and the vehicle lamp of the present embodiment includes the above vehicle lamp optical element assembly of the present embodiment.

Based on the above vehicle lamp, the embodiment of the present invention further provides an automobile, and the automobile of the present embodiment includes the above vehicle lamp of the present embodiment.

The above is merely a preferred embodiment of the present invention, and it should be noted that, for those skilled in the art, a number of improvements and substitutions can be made without departing from the technical principles of the present invention. These improvements and substitutions should also be considered as falling within the protection scope of the present invention.

What is claimed is:

1. A vehicle lamp optical element assembly, comprising a primary optical element assembly (1) and a secondary optical element assembly (2), wherein the primary optical element assembly (1) comprises a primary optical element (11) and a first support (12) for supporting the primary optical element (11), and the secondary optical element assembly (2) comprises a secondary optical element (21) and a second support (22) for supporting the secondary optical element (21), wherein the first support (12) and the second support (22) are connected in a matching manner so as to enable the primary optical element (11) and the secondary optical element (21) to be relatively fixed, wherein the second support (22) is provided with a slot (221), the first support (12) is matched with the slot (221) in an inserting manner, and the first support (12) is provided with positioning surfaces in contact with surfaces on the inner side of the slot (221);

wherein the secondary optical element (21) is arranged at a front end of the second support (22), and the slot (221) penetrates through a rear end face (22*a*) of the second support (22) and extends from back to front, the positioning surfaces of the first support (12) comprise a front positioning surface arranged at a front end face of the first support (12), an upper positioning surface arranged at an upper surface of the first support (12) and a lower positioning surface arranged at a lower surface of the first support (12), wherein the front positioning surface is in contact with a front surface (221*a*) on the inner side of the slot (221), the upper positioning surface is in contact with an upper surface (221*b*) on the inner side of the slot (221), and the lower positioning surface is in contact with a lower surface (221*c*) on the inner side of the slot (221).

2. The vehicle lamp optical element assembly according to claim 1, wherein the first support (12) comprises a supporting frame (121) and a limiting element (122), and the limiting element (122) is fixedly arranged on the primary optical element (11), wherein the supporting frame (121) is provided with a limiting slot (123), and the limiting element (122) is connected with the limiting slot (123) in a matching manner and is relatively fixed with the supporting frame (121).

3. The vehicle lamp optical element assembly according to claim 2, wherein the limiting element (122) is provided with a first positioning hole (124), and the limiting slot (123) is internally provided with a first positioning pin (125) which is matched with the first positioning hole (124) in an inserting manner.

4. The vehicle lamp optical element assembly according to claim 1, wherein the slot (221) penetrates through the second support (22) in the left-right direction, and the first support (12) is provided with clamping parts (126) on the left and right sides, respectively, and two opposite inner side surfaces (126*a*) of the two clamping parts (126) are in contact with the left and right side surfaces of the second support (22), respectively.

5. The vehicle lamp optical element assembly according to claim 1, wherein a rear end of the first support (12) is provided with a rear positioning surface configured to connect with a surface (3*a*) of a circuit board (3), and the rear end face (22*a*) of the second support (22) is provided with a protruding part (223) in communication with the surface (3*a*) of the circuit board (3).

6. The vehicle lamp optical element assembly according to claim 1, wherein the rear end of the first support (12) is provided with a second positioning pin (127) configured to be matched with a second positioning hole (31) on the circuit board (3) in an inserting manner.

7. A vehicle lamp, comprising the vehicle lamp optical element assembly according to claim 1.

8. An automobile, comprising the vehicle lamp according to claim 7.

* * * * *